US007982125B2

(12) United States Patent
Takabayashi et al.

(10) Patent No.: US 7,982,125 B2
(45) Date of Patent: Jul. 19, 2011

(54) TRANSDUCER AND STRINGED MUSICAL INSTRUMENT INCLUDING THE SAME

(75) Inventors: Yojiro Takabayashi, Hamamatsu (JP); Kenta Hori, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 428 days.

(21) Appl. No.: 11/924,536

(22) Filed: Oct. 25, 2007

(65) Prior Publication Data

US 2008/0092724 A1 Apr. 24, 2008

Related U.S. Application Data

(63) Continuation-in-part of application No. 11/413,768, filed on Apr. 27, 2006, now abandoned.

(30) Foreign Application Priority Data

Apr. 28, 2005 (JP) ..... 2005-131425
Apr. 28, 2005 (JP) ..... 2005-131434

(51) Int. Cl.
*G10H 3/00* (2006.01)
*G10H 3/14* (2006.01)
*G10H 3/18* (2006.01)

(52) U.S. Cl. ..... 84/731; 84/723; 84/730

(58) Field of Classification Search ..... 84/723, 84/730, 731
See application file for complete search history.

(56) References Cited

U.S. PATENT DOCUMENTS 3,668,295 A 6/1972 Broussard
3,733,425 A 5/1973 Chaki
4,218,951 A 8/1980 Tressel
4,378,721 A * 4/1983 Kaneko et al. ..... 84/731
4,501,186 A * 2/1985 Ikuma ..... 84/726
4,785,704 A 11/1988 Fishman
4,941,389 A 7/1990 Wendler
5,078,041 A * 1/1992 Schmued ..... 84/731
5,123,325 A 6/1992 Turner
5,438,157 A 8/1995 Lace et al.
5,539,147 A 7/1996 Hoshino
5,552,562 A * 9/1996 Hertz et al. ..... 84/726
5,670,733 A * 9/1997 Fishman ..... 84/731
5,837,915 A 11/1998 Suenaga (Continued)

FOREIGN PATENT DOCUMENTS

CN 1555045 A 12/2004

(Continued)

OTHER PUBLICATIONS

Japanese Notice of Reason(s) for Refusal (Office Action) for JP Patent Application No. 2005-131425, mailed Jul. 29, 2008.

(Continued)

*Primary Examiner* — Jeffrey Donels
*Assistant Examiner* — Andrew R Millikin
(74) *Attorney, Agent, or Firm* — Morrison & Foerster LLP

(57) ABSTRACT

A transducer includes a piezoelectric element attached to a stringed musical instrument with an adhesive layer, and at least one intermediate layer provided in a thickness-wise middle portion of the adhesive layer and made of a material different from a material of the adhesive layer. The transducer has a mounting surface attached to face a back surface of a top of a body of the stringed musical instrument, and the mounting surface is disposed in an area, in the top, including an area right under an installation area of a bridge which is provided on a front surface of the top and supports a saddle supporting one-end sides of strings.

11 Claims, 6 Drawing Sheets

U.S. PATENT DOCUMENTS

| | | | | |
|---|---|---|---|---|
| 5,900,572 | A | 5/1999 | Aaroe | |
| 5,955,694 | A | 9/1999 | Sakurai | |
| 6,191,350 | B1 * | 2/2001 | Okulov et al. | 84/646 |
| 6,605,771 | B1 * | 8/2003 | Baggs | 84/731 |
| 6,815,604 | B2 | 11/2004 | Toda | |
| 6,822,156 | B1 | 11/2004 | Lazarus | |
| 2002/0092403 | A1 | 7/2002 | McGuire, Jr. et al. | |
| 2003/0061932 | A1 | 4/2003 | Tanaka et al. | |
| 2004/0105560 | A1 | 6/2004 | Naniki | |
| 2005/0087062 | A1 * | 4/2005 | Kiyohiko | 84/723 |
| 2006/0243121 | A1 | 11/2006 | Takabayashi | |

FOREIGN PATENT DOCUMENTS

| | | |
|---|---|---|
| EP | 0119842 | 9/1884 |
| JP | S53-55521 | 5/1978 |
| JP | 53-108222 | 9/1978 |
| JP | S58-7196 | 1/1983 |
| JP | S58-14190 | 1/1983 |
| JP | 60-494 | 1/1985 |
| JP | 07-005881 | 1/1995 |
| JP | 07-146685 | 6/1995 |
| JP | 08-025312 | 1/1996 |
| JP | 8-110781 | 4/1996 |
| JP | 9-244633 | 9/1997 |
| JP | 10-240239 | 9/1998 |
| JP | 2003-316355 | 11/2003 |

OTHER PUBLICATIONS

Japanese Notice of Reason(s) for Refusal (Office Action) for JP Patent Application No. 2005-131434, mailed Jul. 29, 2008.

Japanese Office Action mailed Oct. 28, 2008 for JP 2005-131425.

Japanese Office Action mailed Oct. 28, 2008 for JP 2005-131434.

Questioning by Appeal Examiner mailed Dec. 1, 2009, for JP Application No. 2005-131425, Appeal No. 2008-030099, with Partial English Translation of Report Concerning Reconsideration by Examiner Before Appeal, five pages.

Chinese Office Action mailed Dec. 25, 2009, for CN 200610077703.X, with English Translation, 11 pages.

Notification of Reason(s) for Refusal mailed Mar. 30, 2010, for JP Patent Application No. 2008-329091, with English Translation, six pages.

Trial Decision mailed Apr. 6, 2010, for JP Patent Application 2005-131425, Trial No. 2008-30099, with English Translation, 24 pages.

European Search Report mailed Jul. 6, 2006, for EP Application No. 06008772.3, 11 pages.

* cited by examiner

TRANSDUCER AND STRINGED MUSICAL INSTRUMENT INCLUDING THE SAME

BACKGROUND OF THE INVENTION

1. Field of the Invention

The invention relates to a transducer mounted on a stringed musical instrument to transduce the vibration of strings to an electric signal, and to a stringed musical instrument including the same, and more particularly, to a transducer and a stringed musical instrument which realize improved sound quality of reproduced sound obtained by output from the transducer.

2. Description of the Related Art

An acoustic guitar which is a plucked string instrument having a hollow body and a plurality of strings is one of conventionally known stringed musical instruments. Sound directly heard when such an acoustic guitar is played includes sound produced by the vibration of air caused by the vibration of the strings, sound produced by the vibration of a top of a body caused by the vibration of strings propagating to the top, and sound produced through a sound hole of the body.

As an acoustic guitar, also utilized is that of a type in which a transducer transducing the vibration of strings into an electric signal is provided in a body, and electric sound can be reproduced through an amplifier and so on.

Here, as an acoustic guitar provided with the aforesaid transducer, known are a conventional structure 1 (see FIG. 11 and U.S. Pat. No. 5,123,325 B), a conventional structure 2, and a conventional structure 3 (see JP H7-5881 A) which are described below.

In the conventional structure 1, as shown in FIG. 11, a transducer 51 made of a piezoelectric device which is a long, narrow piece is disposed under a saddle 52. Concretely, the transducer 51 and the saddle 52 are sequentially put in a saddle slot 53A of a bridge 53 mounted on a top of a not-shown body, so that the transducer 51 is sandwiched by the bridge 53 and the saddle 52.

In the conventional structure 2, a transducer including a piezoelectric device is in a plate form and is mounted on an outer surface of a body with an adhesive or the like.

In the conventional structure 3, a transducer includes a coil positioned inside a sound hole and is capable of transducing the vibration of strings into an electric signal by electromagnetic induction of the coil.

In the above-described conventional structure 1, however, since tension of strings gives a downward force to the saddle 52, a relatively strong compressive force constantly acts on the transducer 51. This obstructs free movement of the transducer 51 itself, so that there is a tendency that the complicated vibration of the top caused by performance cannot be thoroughly transduced. This results in a problem that sound reproduced via an amplifier or the like has sound quality and tone quite different from actual performance sound that is directly heard from an acoustic guitar and reproducibility of the performance sound is thus impaired.

Further, in the conventional structure 2, though the transducer senses the vibration of the body, the sensed vibration greatly varies depending on which position of the body it is mounted. Therefore, the work of adjusting the mounting position of the transducer in order to obtain good sound quality and tone becomes difficult and complicated, and the conventional structure 2 thus has a problem of an increased load required for this work.

On the other hand, in the conventional structure 3, since the vibration of a body is not sensed, produced sound is different in sound quality and tone from performance sound that is heard when the transducer is not used. That is, since performance sound heard when the acoustic guitar is played is sound produced by the vibration mainly of a top of the body, the conventional structure 3 sensing mainly the vibration of strings has a problem of insufficient reproducibility.

Further, as a transducer such as a pickup capable of transducing the vibration of strings into an electric signal in a plucked string instrument such as an acoustic guitar as described above, known is that of a type provided with a plate-formed or a sheet-formed piezoelectric device. This piezoelectric device is mounted on a body of a stringed musical instrument via an adhesive layer made of rubber and is connected to an amplifier or the like via a lead wire. Therefore, the vibration of the strings when the stringed musical instrument is played propagates to the body, the adhesive layer, and the piezoelectric device in this order, and electric sound can be reproduced according to an electric signal outputted by the piezoelectric device.

However, in this structure, though the adhesive layer attenuates the vibration of the strings before it propagates to the piezoelectric device, it is difficult to obtain a sufficient attenuating operation only with the adhesive layer, and when the string is plucked with a force which is not very strong, electric output level of the piezoelectric device sometimes reaches the maximum. Consequently, even plucking with a stronger force does not increase the output level and causes almost no change of the output level, which causes a problem that tone and quality of reproduced sound are not satisfactory enough.

Moreover, there is a tendency that a frequency band in which a good attenuating operation is exhibited becomes relatively narrow, so that it becomes difficult to obtain a sufficient attenuating operation in a frequency band requiring the attenuation. As a result, for example, in a case where the adhesive layer exhibits a less sufficient attenuating operation in a mid/low register than in a high register, the output level unnaturally differs between these registers, which also causes deterioration of sound quality and tone.

SUMMARY OF THE INVENTION

The invention was made to solve the above-described problems, and its object is to provide a transducer and a stringed musical instrument including the same which make it possible to reduce workload required for adjustment and the like and make sound reproduced via the transducer as close to sound directly heard from the stringed musical instrument as possible.

In order to achieve the object stated above, a transducer mounted on a stringed musical instrument to transduce vibration of strings into an electric signal includes: a piezoelectric device attached to the stringed musical instrument with an adhesive layer; and at least one intermediate layer provided in a thickness-wise middle portion of the adhesive layer and made of a material different from a material of the adhesive layer.

Preferably, the adhesive layer is made of autohesive non-vulcanized rubber and the intermediate layer is made of wood.

A stringed musical instrument according to the invention is a stringed musical instrument including the above-described transducer, and includes: a plurality of strings arranged in parallel; a hollow body including a top and a back; a saddle supporting one end side areas of the strings; and a bridge provided on a front surface of the top to support the saddle. Further, the transducer has a mounting surface attached to face a back surface of the top of the body and the mounting surface is disposed in an area, in the top, including an area right under an area where the bridge is provided.

Preferably, the body has a reinforcing member in an area under the bridge in the back surface of the top, and the mounting surface of the transducer is attached to the reinforcing member.

The mounting surface of the transducer can be formed of the adhesive layer.

Preferably, pitches of the plural strings gradually change along an arrangement direction of the strings, the transducer is provided in plurality, and the mounting surfaces of the transducers are disposed in an area including an area substantially right under the saddle and in an area apart from the area right under the saddle toward at least one of both sides in the arrangement direction of the strings, respectively.

In these stringed musical instruments, the transducer can be disposed in plurality in the area including the area substantially right under the saddle.

Preferably, pitches of the plural strings in the stringed musical instrument gradually change along an arrangement direction of the strings, the transducer is provided in plurality, and the mounting surfaces of the transducers are disposed in an area including an area substantially right under the saddle and in areas apart from the area right under the saddle toward one and the other of both sides in the arrangement direction of the strings, respectively.

Alternatively, the mounting surfaces of the transducers may be disposed only in areas apart from an area right under the saddle toward one and the other of both sides in the arrangement direction of the strings, respectively.

Preferably, the stringed musical instrument further includes a mixing circuit setting tone by mixing the electric signals outputted from the plural transducers at an arbitrary ratio.

In this case, preferably, the stringed musical instrument further includes: a first amplifier circuit amplifying the electric signal by lowering a gain of an intermediate frequency band, the electric signal being outputted from the transducer, out of the plural transducers, whose mounting surface is disposed in the area including the area substantially right under the saddle; a second amplifier circuit amplifying the electric signal by lowering a gain of a high frequency band, the electric signal being outputted from the transducer closer to a lowest-pitch string, out of the transducers whose mounting surfaces are disposed in the areas apart from the area right under the saddle toward the both sides in the arrangement direction of the strings; a third amplifier circuit amplifying the electric signal by lowering a gain of a low frequency band, the electric signal being outputted from the transducer closer to a highest-pitch string, out of the transducers whose mounting, surfaces are disposed in the areas apart from the area right under the saddle toward the both sides in the arrangement direction of the strings; and a mixing circuit setting tone by mixing the electric signals outputted from the first, second, and third amplifier circuits at an arbitrary ratio.

Alternatively, preferably, the stringed musical instrument further includes: a first amplifier circuit amplifying the electric signal by lowering a gain of a high frequency band, the electric signal being outputted from the transducer closer to a lowest-pitch string, out of the transducers whose mounting surfaces are disposed in the areas apart from the area right under the saddle toward the both sides in the arrangement direction of the strings; a second amplifier circuit amplifying the electric signal by lowering a gain of a low frequency band, the electric signal being outputted from the transducer closer to a highest-pitch string, out of the transducers whose mounting surfaces are disposed in the areas apart from the area right under the saddle toward the both sides in the arrangement direction of the strings; and a mixing circuit setting tone by mixing the electric signals outputted from the first and second amplifier circuits at an arbitrary ratio.

The transducer according to the invention can provide the attenuation effect by the intermediate layer different from the attenuation effect by the adhesive layer, so that the vibration propagating to the piezoelectric device when a string is strongly plucked can be well attenuated. This can lower the output level of the piezoelectric device, so that the output level in accordance with a plucking force can be realized, which makes it possible to improve tone and quality of sound that is reproduced via an electric circuit part and a sound system.

Further, the intermediate layer and the adhesive layer can be designed so that they exhibit the attenuating operations in different frequency bands each other, which makes it possible to expand a frequency band in which a good attenuating operation can be obtained.

Therefore, a change in the output level due to difference in frequency band becomes small, which can also realize improved tone and quality of reproduced sound.

Moreover, if a plurality of types of transducers whose intermediate layers are made of different materials are prepared, it is possible to obtain various kinds of attenuating operations only by changing these transducers, which can facilitate adjusting tone and the like.

In the stringed musical instrument according to the invention, the mounting surface of the transducer is positioned on the back surface side of the top of the body. Therefore, preload due to tension of the strings is not given to the transducer using a piezoelectric device in a sheet form or a thin plate form, so that the vibration of the top is transmitted as it is to the transducer. Consequently, sound reproduced via the transducer becomes similar to performance sound directly heard from the stringed musical instrument, which realizes enhanced reproducibility of the performance sound.

Further, the mounting surface of the transducer is positioned in the area in the top, including the area right under the area where the bridge is provided. Therefore, the vibration propagating to the transducer is less susceptible to the structural influence of braces and the like of the top, which can stabilize quality of reproduced sound.

In addition, since the transducer is not exposed on an outer side of the body, the transducer does not become an obstacle and can be kept mounted constantly, which can lighten a load of adjustment work and the like required in mounting the transducer.

Further, if the mounting surface of the transducer is attached to the reinforcing member, the transducer transduces the vibration of an area, in the body, which vibrates relatively stably, so that acoustic feedback can be prevented, realizing further improved quality of reproduced sound.

Further, if the mounting surfaces of the transducers are disposed in the area including the area substantially right under the saddle and in the areas apart from the area right under the strings toward both sides in the arrangement direction of the strings, the aforesaid reproducibility can be further improved.

Specifically, since the saddle supports the strings, the top in the area right under the saddle is easily excited in substantially parallel to the thickness direction by the vibration of the strings. Accordingly, the electric signal resulting from the transduce in an area including this area becomes reproduced sound close to fundamental tone of sound produced by the vibration of the strings. On the other hand, the electric signal resulting from the transduce on a side of the string producing the highest-pitch sound becomes reproduced sound relatively close to sound produced by air vibration caused by the vibration of the strings. The electric signal resulting from the transduce on a side of the string producing the lowest-pitch sound becomes reproduced sound relatively close to sound produced by the vibration of the top of the body.

In this manner, various types of vibrations can be transduced into the electric signals, and reproduced sound based on the electric signals can be made closer to directly heard natural sound. Moreover, since the electric signals outputted from the respective transducers are mixed at an arbitrary ratio by the mixing circuit directly or via the amplifier circuits (filter circuits) having frequency characteristics, it is possible to facilitate the setting of variety of tones.

Further, when the plural transducers are disposed in the area including the area substantially right under the saddle, for example, transducers transducing mainly the vibration of the high-pitch side strings and transducers transducing mainly the vibration of the low-pitch side strings can be provided separately. This makes it possible to more stably sense the vibrations of the respective strings, realizing further improved sound quality.

Note that in this specification and claims, "upper", "lower", and "left", "right" are used based on FIG. 4, unless otherwise noted. Further, "front" means the upper side in FIG. 3 and "back" means the lower side opposite the upper side.

The above and other object, features and advantages of the invention will be apparent from the following detailed description which is to be read in conjunction with the accompanying drawings.

DETAILED DESCRIPTION OF THE PREFERRED EMBODIMENTS

Figure 1:
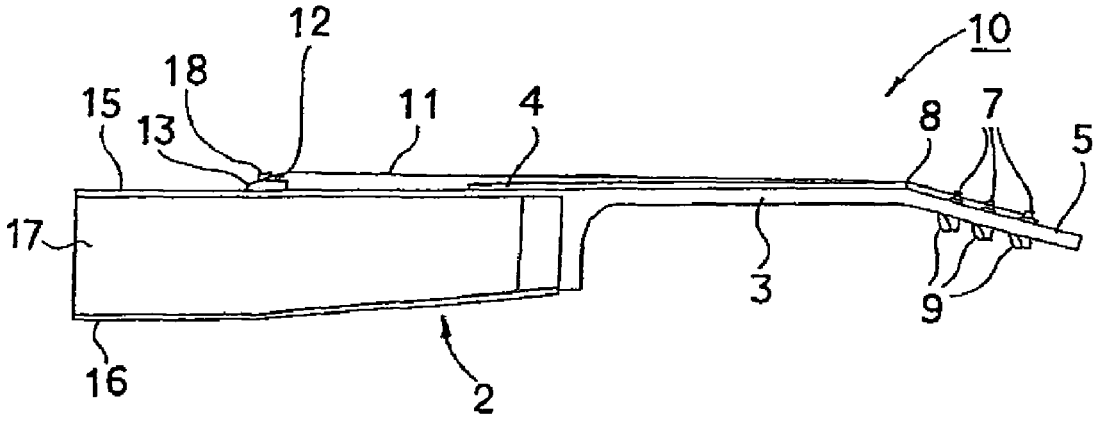
FIG. 1 is a side view showing one embodiment of a stringed musical instrument according to the invention.

Hereinafter, preferred embodiments of the invention will be described with reference to the drawings. First, the external appearance of one embodiment of a stringed musical instrument according to the invention will be described with reference to FIG. 1 and FIG. 2. FIG. 1 is a side view of the stringed musical instrument and FIG. 2 is a plane view seen from an upper side in FIG. 1.

A stringed musical instrument 10 of this embodiment has substantially the same structure as that of an acoustic guitar which is a typical plucked string instrument. A body 2 being an instrument main body of the stringed musical instrument 10 has a top 15 and a back 16 whose outer peripheries are the same in shape, and the body 2 is a hollow resonance body with the outer peripheries of the top 15 and the back 16 being bonded via a curved side panel 17. A circular sound hole 14 is formed in a center portion of a smaller bulging portion of the top 15.

Figure 2:
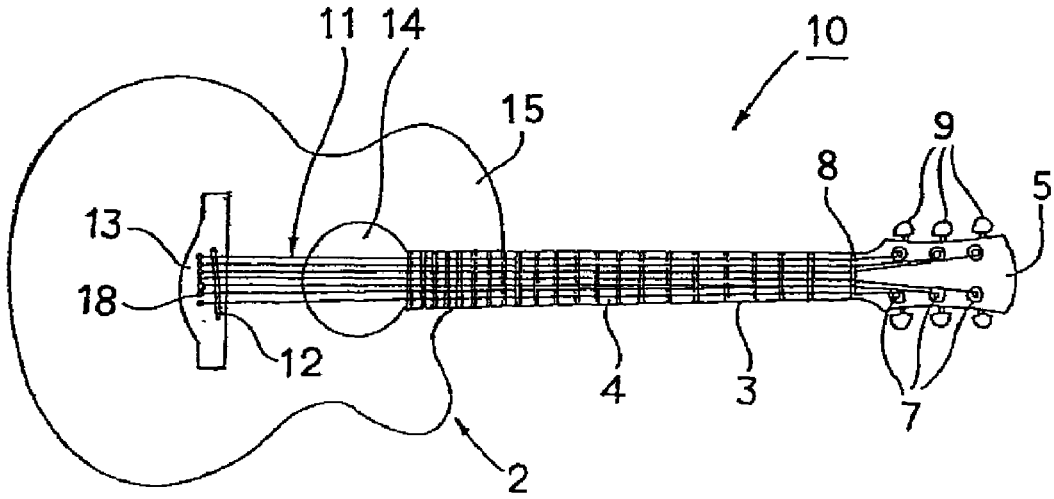
FIG. 2 is a plane view seen from an upper side in FIG. 1.

A neck 3 supporting a fingerboard 4 and having a head 5 at an end portion thereof is fixed to an end portion of the right side of the body 2 in FIG. 1 and FIG. 2. Further, on an opposite side (left side in FIG. 1) of the fingerboard 4 across the sound hole 14, a bridge 13 supporting a saddle 12 is adhesively fixed on a front surface 15*a* of the top 15.

Six tuning keys 7 geared to respective pegs 9 to rotate are provided in the head 5 at the end portion of the neck 3, and between the tuning keys 7 and pins 18 inserted in six through holes formed in the bridge 13, six strings 11 made of steel, gut, or the like are stretched. A nut 8, which is provided on a boundary of the head 5 and the neck 3, and the saddle 12, which is supported by the bridge 13, support the strings 11 to give tension thereto.

Next, a part in this stringed musical instrument relating to the invention will be described in detail with reference to FIG. 3 to FIG. 5.

Figure 3:
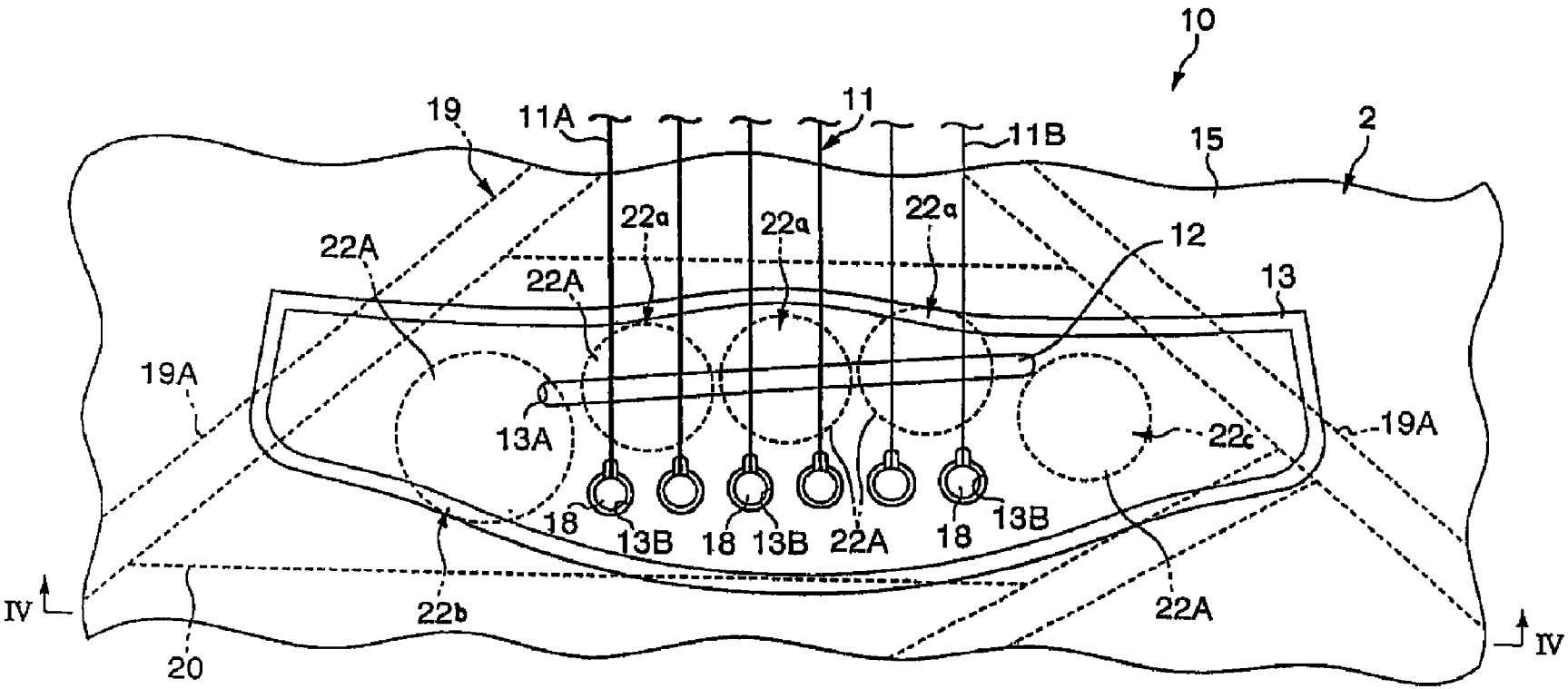
FIG. 3 is a rough plane view showing an enlarged essential portion of the stringed musical instrument shown in FIG. 1 and FIG. 2 and a mounting structure of a transducer.
Figure 4:
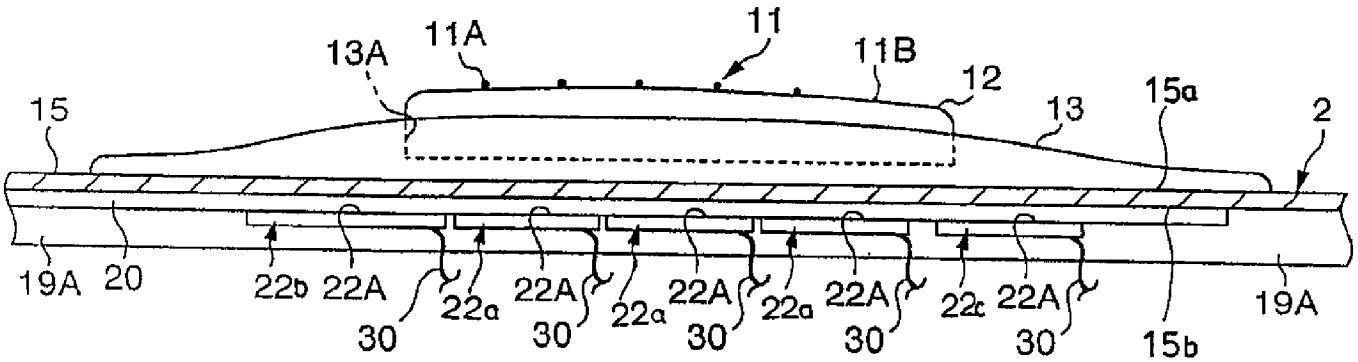
FIG. 4 is a cross sectional view taken along the IV-IV line in FIG. 3, with part of the structure omitted.

FIG. 3 is a rough plane view showing an enlarged essential portion of the stringed musical instrument shown in FIG. 1 and FIG. 2 and a mounting structure of a transducer, and FIG. 4 shows a cross sectional view taken along the IV-IV line in FIG. 3, with part of the structure omitted.

In the stringed musical instrument 10 shown in these drawings, the strings 11 are set so that pitches thereof gradually change to a higher side in their arrangement direction, namely, from the left to right direction. Here, among the strings 11, the left-end string is a string 11A producing the lowest-pitch sound (hereinafter, referred to as the lowest-pitch string 11A), and the right-end string is a string 11B producing the highest-pitch sound (hereinafter, referred to as the highest-pitch string 11B). Generally, pitches of the strings from the lowest-pitch string 11A to the highest-pitch string 11B are tuned to E, A, D, G, B, and E.

The saddle 12 stands on the bridge 13 to extend in the right and left direction, and an upper edge thereof supports back end areas of the strings 11 so as to bend the strings 11. The length of the saddle 12 in the arrangement direction of the strings 11 is set so that both ends thereof are positioned outside the lowest-pitch string 11A and the highest-pitch string 11B.

The bridge 13 is made of, for example, ebony and has a plate shape along the front surface 15*a* of the top 15, though this is not restrictive. The bridge 13 gets gradually thinner toward a part thereof more distant from the saddle 12, and a saddle slot 13A receiving the saddle 12 is formed on an upper face side of the bridge 13. Further, the bridge 13 has at the back of the saddle 12 six holes 13B to which the pins 18 are inserted, and the pins 18 support the back end sides of the strings 11.

The bridge 13 is fixed with an adhesive or the like on the front surface 15*a* of the top 15 of the body 2. A plurality of braces 19 for reinforcing the top 15 are attached to a back surface 15*b* side of the top 15. Two braces 19A, 19A out of these braces 19 are provided to extend in intersecting directions between the bridge 13 and the sound hole 14 shown in FIG. 2.

Further, a plate-shaped reinforcing member 20 is provided in an area between the two braces 19A, 19A under the bridge 13 on the back surface 15*b* side of the top 15, and the reinforcing member 20 reinforces an area, in the top 15, where the bridge 13 is mounted and to which load is given by the tension of the strings 11.

On a lower face of the reinforcing member 20, a plurality of transducers 22 (22*a*, 22*b*, 22*c*) capable of transducing vibration of the strings 11 into electric signals are provided.

Each of the transducers 22 is formed in a plate form or a sheet form having a substantially circular shape when seen from above. An upper face of each of the transducers 22 is a mounting surface 22A attached to the lower face of the reinforcing member 20 and faces the back surface 15*b* of the top 15. The mounting surfaces 22A are respectively arranged in an area including an area right under an area, in the top 15, where the bridge 13 is disposed, and concretely, are arranged so as to hardly run off the edge of the installation area of the bridge 13 in the state in FIG. 3 showing a plane view of the bridge 13.

As the transducers 22, three are provided under the saddle 12, one is provided at a position apart in the left direction from the lowest-pitch string 11A, and one is provided at a position apart in the right direction from the highest-pitch string 11B. The mounting surfaces 22A of the transducers 22*a* under the saddle 12 are disposed in an area including an area substantially right under the saddle 12, and center portions of these surfaces are positioned between the lowest-pitch string 11A and its adjacent string 11, between the highest-pitch string 11B and its adjacent string 11, and between the two center strings, respectively.

The mounting surface 22A of the transducer 22*b* on the left side of the lowest-pitch string 11A is disposed between the lowest-pitch string 11A and the brace 19A overlapping with a left end side of the bridge 13. On the other hand, the mounting surface 22A of the transducer 22*c* on the right side of the highest-pitch string 11B is disposed between the highest-pitch string 11B and the brace 19A overlapping with the right end side of the bridge 13.

Figure 5:
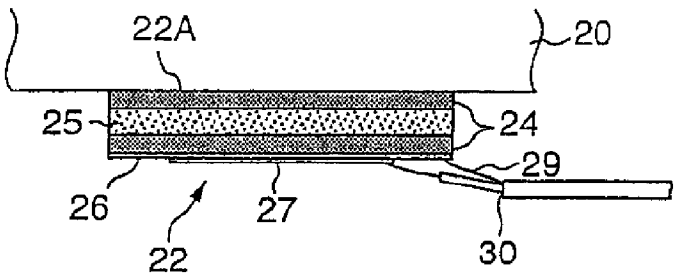
FIG. 5 is a cross sectional view showing a layered structure of the transducer according to the invention shown in FIG. 3 and FIG. 4.

Each of the transducers 22 (22*a*, 22*b*, 22*c*) is the transducer according to the invention, and for example, has a layered structure as shown in FIG. 5. Specifically, it includes an adhesive layer 24 bonded to the lower face of the reinforcing member 20, an intermediate layer 25 provided in a thicknesswise middle portion of the adhesive layer 24, and a piezoelectric device 27 in a sheet form or a plate form mounted on a lower face of the adhesive layer 24 via a metal plate 26 made of brass or the like.

The adhesive layer 24 is made of, for example, butyl rubber or synthetic rubber in butyl rubber series. Butyl rubber or synthetic rubber in butyl rubber series comes in various kinds depending on composition, however they are preferably non-vulcanized and autohesive. The intermediate layer 25 is made of a material different from the material of the adhesive layer 24, and in this embodiment, wood such as maple is used. A ground wire 29 is connected to the metal plate 26, and a lead wire 30 is connected to the piezoelectric device 27.

The piezoelectric device 27 senses the vibration of the top 15 caused by the vibration of the plucked strings 11, transduces the vibration into an electric signal, and outputs the electric signal to an electric circuit part in the body 2 via the lead wire 30. The electric circuit part is capable of amplifying and impedance-converting the electric signal outputted from each of the transducers 22 by an operational amplifier and so on to output it to a sound system (an amplifier, a speaker, and so on) provided outside the stringed musical instrument 10, via a mixing circuit, an equalizing circuit, and so on.

In the sound system, the electric signal inputted from the stringed musical instrument 10 is amplified by the amplifier and electroacoustically transduced by the speaker to be outputted as performance sound.

In the above-described structure, as a result of plucking for playing the stringed musical instrument 10, the vibration of the strings 11 propagates to the saddle 12, the bridge 13, the top 15, and each of the transducers 22 in sequence to be transduced into the electric signal by each of the transducers 22. The electric signal resulting from the transduce in each of the transducers 22 is outputted to the aforesaid electric circuit part via the lead wire 30 and further reproduced as sound by the external sound system.

Here, the vibration of the top 15 propagating to each of the transducers 22 differs depending on the thickness of the bridge 13 and the positional relation with each of the strings 11, and reproduced sound also differs accordingly.

To be in more detail, as for the area of the top 15 under the saddle 12, the thickness of the bridge 13 in an area right thereabove is large and the distance to the saddle 12 which becomes an excitation portion by supporting the strings 11 is short, so that this area of the top 15 is easy to vibrate, being displaced substantially in parallel to the thickness direction. Therefore, each of the transducers 22 under the saddle 12 is capable of stably sensing and reproducing tone close to fundamental tone of the vibration of the strings 11.

Further, as for areas of the top 15 on the right and left sides of the saddle 12, the thickness of the bridge 13 in areas right thereabove is small, so that the bridge 13 in these areas is less stronger than in the area under the saddle 12, but since the strength increases as the distance to the braces 19A, 19A is shorter, vibration displacement in these areas of the top 15 is slightly complexed. Therefore, the transducer 22*b* on the left side of the lowest-pitch string 11A increases a harmonic component, and since it is close to the lowest-pitch string 11A, it is capable of stably sensing and reproducing tone close to sound that is directly heard when the top 15 vibrates.

The transducer 22*c* on the right side of the highest-pitch string 11B also increases a harmonic component, and since it is close to the highest-pitch string 11B, it is capable of stably sensing and reproducing tone similar to sound produced by the vibration of air caused by the vibration of the strings 11.

Since it is thus possible to sense the vibrations whose tone differs depending on the mounting positions of the transducers 22, it is possible to set tone according to variety of music scenes by arbitrarily mixing and adjusting the electric signals outputted from the respective transducers 22, by the aforesaid mixing circuit of the electric circuit part.

For example, when a volume ratio is set as A:B:C=2:3:5, where A is volume of the transducers 22*a* under the saddle 12, B is volume of the transducer 22*b* on the left side of the lowest-pitch string 11A, and C is volume of the transducer 22*c* on the right side of the highest-pitch string 11B, the resultant sound is expected to have tone emphasizing sound of the stringed musical instrument 10 in solo, and when the volume ratio is set as A:B:C=3:2:5, the resultant sound is expected to have articulate tone emphasizing chord performance.

Incidentally, in each of the transducers 22, the vibration propagating to the piezoelectric device 27 from the mounting surface 22A is attenuated by the adhesive layer 24 and the intermediate layer 25. In particular, the intermediate layer 25 made of maple is excited to consume vibration energy, so that it is capable of lowering the output level of the piezoelectric device 27 to a predetermined value or lower. Consequently, it can be avoided that even an increased plucking force cannot change the output level, as is the case in the conventional structure, so that it is possible to improve tone and quality of reproduced sound.

Further, the adhesive layer 24 made of butyl rubber can effectively exhibit the attenuating operation in a high register, which makes it possible to obtain clear tone with unnecessary reverberation eliminated. On the other hand, the intermediate layer 25 can exhibit an attenuating operation in frequency bands different from that in which the adhesive layer 24 exhibits the attenuating operation, namely, in a low register and a mid register, and can also provide an attenuation characteristic that butyl rubber does not have and that is unique to maple, and a tone correction effect. Therefore, it is possible to expand the frequency band where a good attenuating operation is obtainable by the intermediate layer 25 and to reduce or adjust unnecessary frequency components, which also makes it possible to realize better tone and sound quality.

Further, according to this embodiment, since the respective transducers 22 are mounted on the reinforcing member 20 positioned right under the saddle 12, the vibration of the stably vibrating area in the top 15 can be picked up, so that it is possible to prevent the occurrence of acoustic feedback and thus maintain good quality and tone of electrically reproduced sound. Further, owing to the attenuation of the vibration by the intermediate layer 25, the electric signal outputted to the electric circuit part can be changed according to a plucking force.

Further, since the respective transducers 22 are mounted on the lower face of the reinforcing member 20 inside the body 2, the transducers 22 do not become obstacles even if this mounting state is constantly kept. This eliminates a need for mounting/dismounting the transducers 22 and adjusting the outputs from the transducers 22 every time the stringed musical instrument 10 is put into and taken out of a case.

Moreover, providing the three transducers 22*a* substantially right under the saddle 12 can prevent volume difference among the strings, realizing improved sound quality.

Here, an example of a mixing part mixing the electric signals outputted from the transducers shown in FIG. 3 and FIG. 4 and outputting the resultant electric signal will be described with reference to the block diagram shown in FIG. 6 and the diagrams shown in FIG. 8 to FIG. 10. As for transducer mounting portions in FIG. 6, only the transducers 22*a*, 22*b*, 22*c* and the strings 11 are shown by the solid lines, and the saddle 12, the bridge 13, and the pins 18 are shown by the virtual lines.

In this example, the electric signals outputted from the respective three transducers 22*a* whose mounting surfaces 22A are disposed in the area including the area substantially right under the saddle 12 are mixed via mixing resistors R1, R2, R3, and the resultant electric signal is amplified by an amplifier circuit 31 as a first amplifier circuit that amplifies the electric signal by lowering a gain of an intermediate frequency band, and the amplified electric signal is inputted to a mixing circuit 40.

Further, the electric signal outputted from the transducer 22*b* closer to the lowest-pitch string 11A, out of the transducers 22*b*,22*c* whose mounting surfaces 22A are disposed in the areas apart from the area right under the saddle 12 toward both sides in the arrangement direction of the strings 11 is amplified by an amplifier circuit 32 as a second amplifier circuit that amplifies the electric signal by lowering a gain of a high frequency band, and the amplified electric signal is inputted to the mixing circuit 40.

Further, the electric signal outputted from the transducer 22*c* closer to the highest-pitch string 11B, out of the transducers 22*b*,22*c* whose mounting surfaces 22A are disposed in the areas apart from the area right under the saddle 12 toward both sides in the arrangement direction of the strings 11 is amplified by an amplifier circuit 33 as a third amplifier circuit that amplifies the electric signal by lowering a gain of a low frequency band, and the amplified electric signal is inputted to the mixing circuit 40.

Figure 9:
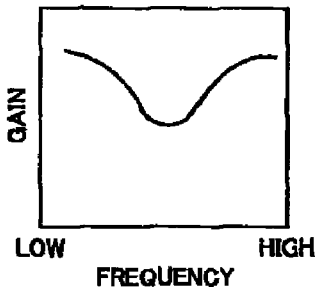

A frequency characteristic of the gain of the amplifier circuit 31 is such that the gain of the intermediate frequency band is low and the gains of the low frequency band and the high frequency band are high, as shown in FIG. 9, and the amplifier circuit 31 has a function of a low/high pass filter.

Figure 8:
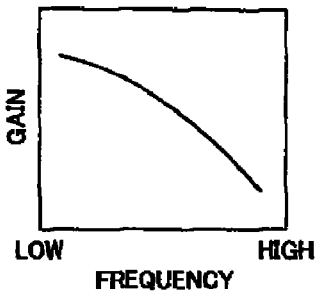
FIG. 8, FIG. 9, and FIG. 10 are diagrams showing frequency characteristics of gains in amplifier circuits 32, 31, 33 shown in FIG. 6, respectively.

A frequency characteristic of the gain of the amplifier circuit 32 is such that as the frequency becomes higher, the gain becomes lower and thus the gain of the low frequency band is higher as shown in FIG. 8, and this amplifier circuit 32 has a function of a low pass filter.

Figure 10:
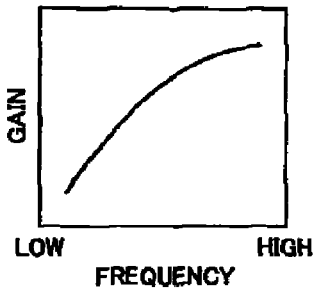
Figure 11:
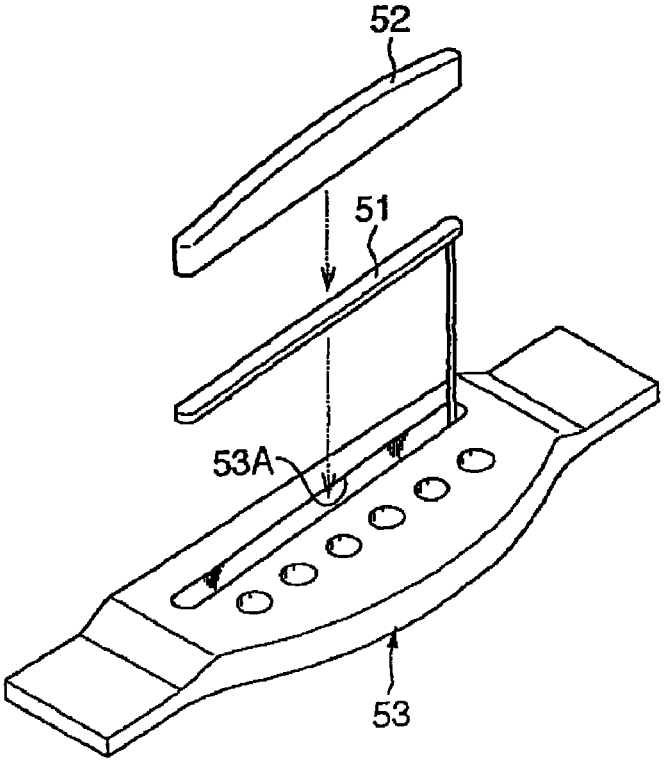
FIG. 11 PRIOR ART
FIG. 11 is an exploded perspective view showing an example of a mounting structure of a transducer in a conventional stringed musical instrument.

A frequency characteristic of the gain of the amplifier circuit 33 is such that as the frequency becomes lower, the gain becomes lower and thus the gain of the high frequency band is higher as shown in FIG. 10, and this amplifier circuit 33 has a function of a high pass filter.

The mixing circuit 40 adjusts a mixing ratio of the electric signals inputted from the amplifiers 31, 32, 33 by three volumes 41, 42, 43, mixes these electric signals at the adjusted mixing ratio, amplifies the resultant electric signal by an amplifier circuit 44 whose frequency characteristic of a gain is flat, and outputs the amplified electric signal to the sound system via a connector or the like. According to this example, tone of reproduced sound can be arbitrarily adjusted and sound quality can also be improved.

Figure 6:
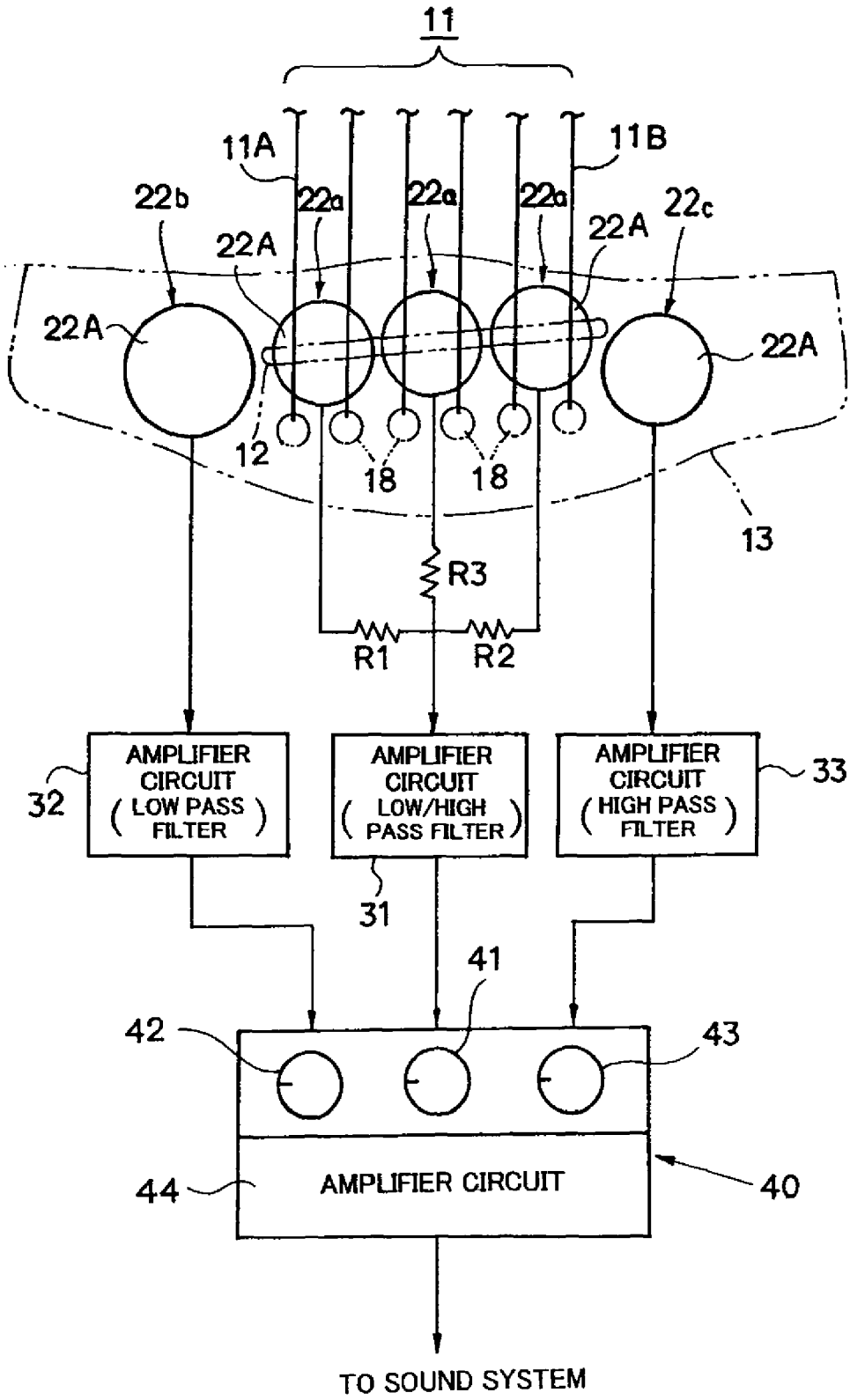
FIG. 6 is a block diagram showing an example of a mixing part mixing electric signals outputted from the transducers shown in FIG. 3 and FIG. 4 to output the resultant electric signal.
Figure 7:
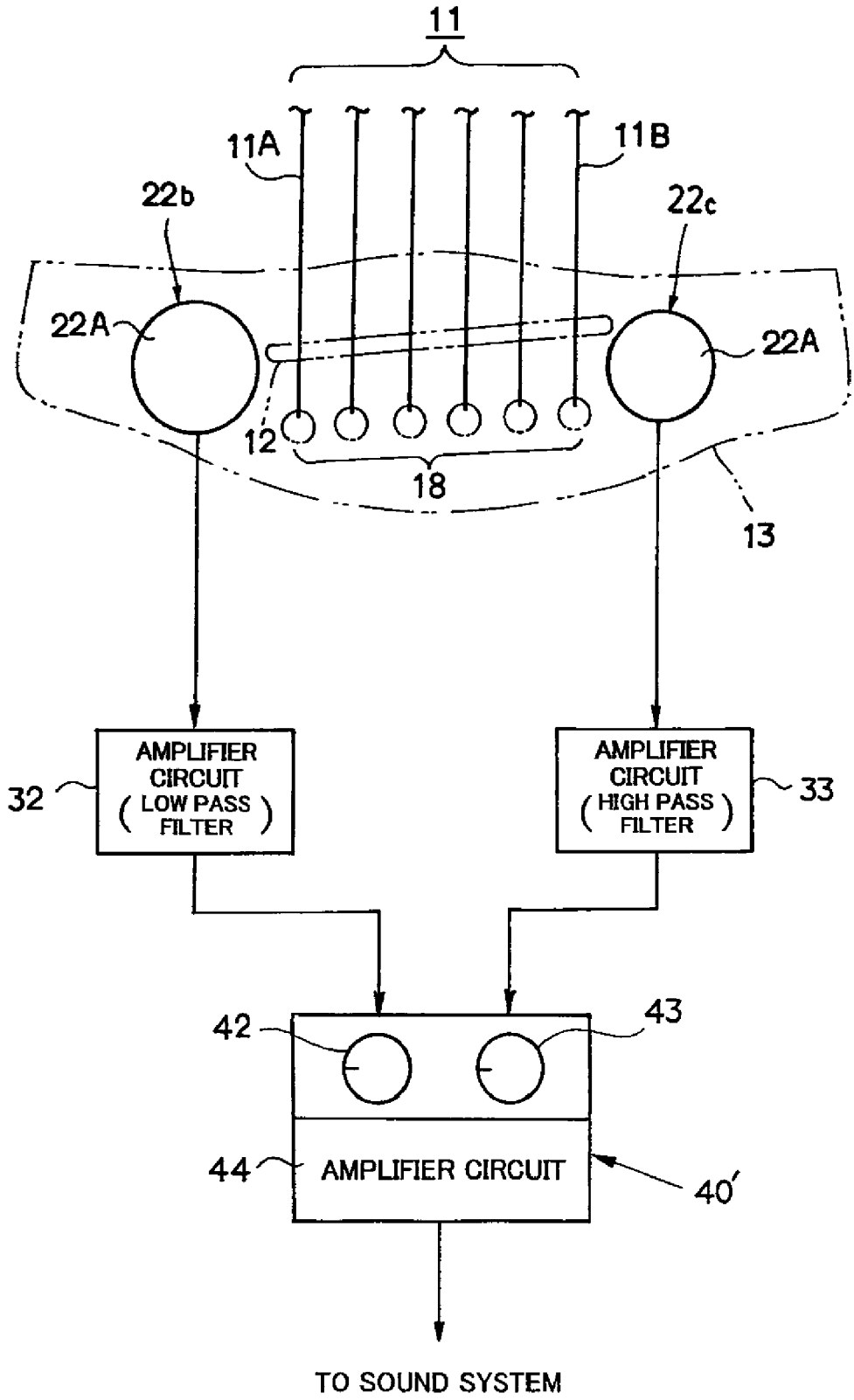
FIG. 7 is a block diagram showing an example of a mixing part mixing electric signals outputted from the transducers attached in a lowest-pitch string side area and a highest-pitch string side area which do not include an area right under a saddle.

Another example shown in FIG. 7 does not include the three transducers 22*a*, shown in FIG. 6, whose mounting surfaces 22A are disposed in the area including the area right under the saddle 12, and includes only the transducers 22*b* and 22*c* attached in the areas close to the lowest-pitch string 11A and the highest-pitch string 11B, which areas do not include the area right under the saddle 12.

The amplifier circuit 32 that amplifies an electric signal by lowering a gain of a high-frequency band (in this example, a first amplifier circuit) amplifies the electric signal outputted from the transducer 22*b* on the lowest-pitch string side, and inputs the amplified electric signal to a mixing circuit 40'. Further, the amplifier circuit 33 that amplifies an electric signal by lowering a gain of a low frequency band (in this example, a second amplifier circuit) amplifies the electric signal outputted from the transducer 22*c* on the highest-pitch string side, and inputs the amplified electric signal to the mixing circuit 40'.

The mixing circuit 40' arbitrarily adjusts a mixing ratio of the electric signals inputted from the amplifier circuits 32, 33 by two volumes 42, 43, mixes the electric signals at the adjusted mixing ratio, amplifies the resultant electric signal by an amplifier circuit 44 whose frequency characteristic of a gain is flat and outputs the amplified electric signal to the sound system via a connector or the like.

According to this example, in a case where the mixing ratio of the electric signals inputted from the amplifier circuits 32, 33 is set to 1:1, the amplified signals with the frequency characteristics shown in FIG. 8 and FIG. 10 of the amplifier circuits 32, 33 are evenly mixed, so that reproduced sound with a substantially flat frequency characteristic can be obtained. Further, by varying the mixing ratio of the electric signals inputted from the amplifier circuits 32, 33, it is possible to emphasize a low register and emphasize a high register.

Further, since the number of the transducers is only two, cost reduction is realized.

The foregoing description has disclosed the best structure, method, and so on for carrying out the invention, but the present invention is not limited thereto.

Therefore, though the specific embodiment of the invention is shown in the drawings and described, the shapes, positions, materials, directions, or other detailed structures of the embodiment described above can be modified in various ways by those skilled in the art without departing from the technical idea and scope of the object of the invention.

Therefore, the above-disclosed description limiting the shape and so on are only given as an example for easy understanding of the invention and does not limit the invention. Therefore, description in the names of members without part or all of the restrictions of the shapes and so on are also included in the invention.

For example, in the stringed musical instrument of the invention, other possible structure is to omit the reinforcing member 20 and attach the mounting surfaces 22A of the respective transducers 22 directly to the back surface of the top 15. However, in view of obtaining the aforesaid operations and effects, it is more preferable to provide the reinforcing member 20 and dispose the plural transducers 22 as in the above-described embodiment.

Further, the number of the transducers 22 installed under the saddle 12 may be changed, and may be, for example six or one. When the number of the transducers 22 is six, the center portions of their surfaces are preferably positioned substantially right under the saddle 12 and the respective strings 11, and when the number of the transducers 22 is one, the center portion of its surface is preferably positioned substantially right under the longitudinal center portion of the saddle 12.

Further, the invention is applicable also to various kinds of other stringed musical instruments such as a classic guitar, a ukulele, a mandolin, and the like.

The mounting positions of the transducers 22 according to the invention can be changed in various ways, and for example, the transducers 22 may be attached with adhesive layer on outer surfaces or the like of the top 15 or the back 16 of the body 2. Further, the material of the intermediate layer 25 provided in the middle of the adhesive layer 24 is not limited to maple and various materials such as other wood may be used.

Therefore, by preparing a plurality of types of the transducers 22 whose intermediate layers are made of different materials and changing the transducers 22, it becomes possible to obtain different attenuation characteristics and tones ascribable to the materials of the intermediate layer 25, which can facilitate adjusting and correcting the tone.

Moreover, the intermediate layer 25 may be formed in plurality, and in this case, the adhesive layer 24 is further interposed between the respective intermediate layers. Further, the planar size of the intermediate layer 25 may be smaller than that of the adhesive layer 24, or the intermediate layer 25 smaller than the adhesive layer 24 may be arranged in plurality in the same plane.

What is claimed is:

1. A stringed musical instrument comprising a plurality of separately and removably mounted transducers to transduce vibration of strings into an electric signal, each of said transducers comprising:

a piezoelectric device attached to the stringed musical instrument with an adhesive layer; and at least one intermediate layer provided within a thickness-wise middle portion of the adhesive layer and made of a material different from a material of the adhesive layer, wherein said adhesive layer is made of autohesive non-vulcanized rubber, and wherein the respective intermediate layers of said plurality of transducers are comprised of different compositions of wood material.

2. A stringed musical instrument including the transducer according to claim 1, the instrument further comprising:

a plurality of strings arranged in parallel; a hollow body including a top and a back; a saddle supporting one end side areas of the strings; and a bridge provided on a front surface of the top to support said saddle, wherein each of said plurality of transducers has a mounting surface attached to face a back surface of the top of said body and the mounting surface is disposed in an area, in the top, including an area right under an area where said bridge is provided.

3. A stringed musical instrument according to claim 2, wherein said body has a reinforcing member in an area under said bridge in the back surface of the top, and the mounting surface of each transducer is attached to the reinforcing member.

4. A stringed musical instrument according to claim 2, wherein the mounting surfaces of said plurality of transducers are formed of the respective adhesive layers.

5. A stringed musical instrument according to claim 2, wherein pitches of said plural strings gradually change along an arrangement direction of said strings, and the mounting surfaces of said transducers are disposed in an area including an area substantially right under said saddle and in an area apart from the area right under said saddle toward at least one of both sides in the arrangement direction of said strings, respectively.

6. A stringed musical instrument according to claim 5, wherein said transducer is disposed in plurality in the area including the area substantially right under said saddle.

7. A stringed musical instrument according to claim 6, further comprising a mixing circuit setting tone by mixing the electric signals outputted from said plural transducers at an arbitrary ratio.

8. A stringed musical instrument according to claim 2, wherein pitches of said plural strings gradually change along an arrangement direction of said strings, and the mounting surfaces of said transducers are disposed in an area including an area substantially right under said saddle and in areas apart from the area right under said saddle toward one and the other of both sides in the arrangement direction of said strings, respectively.

9. A stringed musical instrument according to claim 8, further comprising:

a first amplifier circuit amplifying the electric signal by lowering a gain of an intermediate frequency band, the electric signal being outputted from the transducer, out of said plural transducers, whose mounting surface is disposed in the area including the area substantially right under said saddle;

a second amplifier circuit amplifying the electric signal by lowering a gain of a high frequency band, the electric signal being outputted from the transducer closer to a lowest-pitch string, out of said transducers whose mounting surfaces are disposed in the areas apart from the area right under said saddle toward the both sides in the arrangement direction of said strings;

a third amplifier circuit amplifying the electric signal by lowering a gain of a low frequency band, the electric signal being outputted from the transducer closer to a highest-pitch string, out of said transducers whose mounting surfaces are disposed in the areas apart from the area right under said saddle toward the both sides in the arrangement direction of said strings; and a mixing circuit setting tone by mixing the electric signals outputted from said first, second, and third amplifier circuits at an arbitrary ratio.

10. A stringed musical instrument according to claim 2, wherein pitches of said plural strings gradually change along an arrangement direction of said strings, and the mounting surfaces of said transducers are disposed in areas apart from an area right under said saddle toward one and the other of both sides in the arrangement direction of said strings, respectively.

11. A stringed musical instrument according to claim 10, further comprising:

a first amplifier circuit amplifying the electric signal by lowering a gain of a high frequency band, the electric signal being outputted from the transducer closer to a lowest-pitch string, out of said transducers whose mounting surfaces are disposed in the areas apart from the area right under said saddle toward the both sides in the arrangement direction of said strings;

a second amplifier circuit amplifying the electric signal by lowering a gain of a low frequency band, the electric signal being outputted from the transducer closer to a highest-pitch string, out of said transducers whose mounting surfaces are disposed in the areas apart from the area right under said saddle toward the both sides in the arrangement direction of said strings; and a mixing circuit setting tone by mixing the electric signals outputted from said first and second amplifier circuits at an arbitrary ratio.

* * * * *